United States Patent [19]

Jensen

[11] 4,074,679

[45] Feb. 21, 1978

[54] FIREPLACE STOVE

[76] Inventor: John Frank Jensen, 5220 Ponder, Boise, Idaho 83702

[21] Appl. No.: 628,371

[22] Filed: Nov. 3, 1975

[51] Int. Cl.[2] ..... F24B 7/00

[52] U.S. Cl. ..... 126/121; 126/131

[58] Field of Search ..... 126/120, 121, 127, 128, 126/129, 130, 131, 137; 237/51

[56] References Cited

U.S. PATENT DOCUMENTS

| | | | |
|---|---|---|---|
| 1,470,542 | 10/1923 | Poling | 126/137 |
| 2,181,624 | 11/1939 | Maurer | 126/121 |
| 2,231,258 | 2/1941 | Elmore | 126/121 |
| 2,375,318 | 5/1945 | Mudgett | 126/120 |
| 2,752,913 | 7/1956 | Case | 126/121 |
| 2,821,975 | 2/1948 | Thulman | 126/130 |
| 3,910,251 | 10/1975 | Andrew | 126/120 |

FOREIGN PATENT DOCUMENTS

| | | | |
|---|---|---|---|
| 561,971 | 6/1944 | United Kingdom | 237/51 |
| 857,191 | 12/1960 | United Kingdom | 126/121 |

*Primary Examiner*—Ronald C. Capossela
*Attorney, Agent, or Firm*—Fleit & Jacobson

[57] ABSTRACT

A fireplace stove for heating space in a building structure which includes an outer cabinet in which is disposed a combustion enclosure in spaced-apart relationship with the cabinet sidewall and grate means to form a clearance space, together with an ash receptacle being mounted in the lower end of the combustion enclosure for burning a combustible medium, with an air inlet being provided in the cabinet for admitting air to be heated into the clearance space and an air outlet in the cabinet for discharging heated air from the clearance into the surrounding space, the combustion enclosure, together with the cabinet, being mounted in spaced relationship with a supporting surface and having air deflector means for admitting combustion air into the bottom of the combustion enclosure, and a conduit for removing combustion gases from the interior of the combustion enclosure.

6 Claims, 5 Drawing Figures

FIG. 4
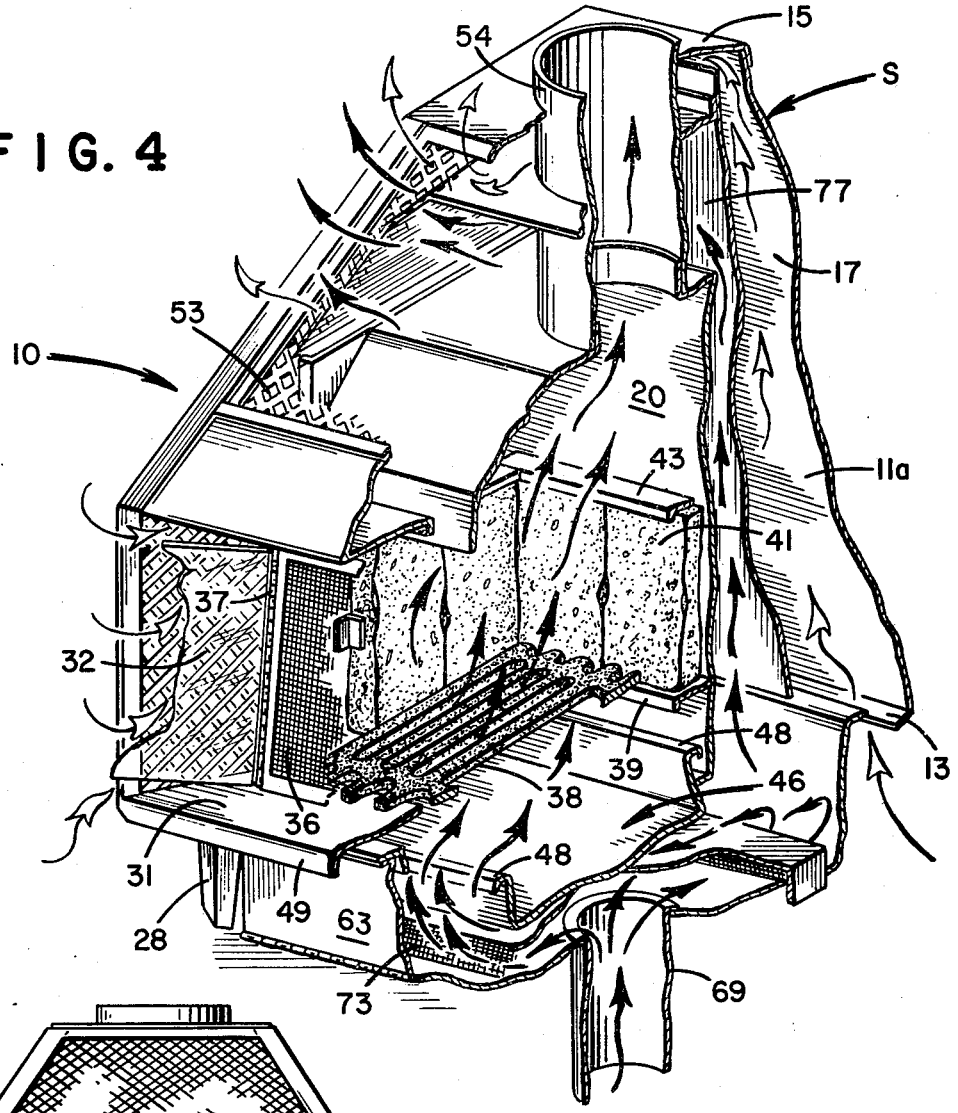
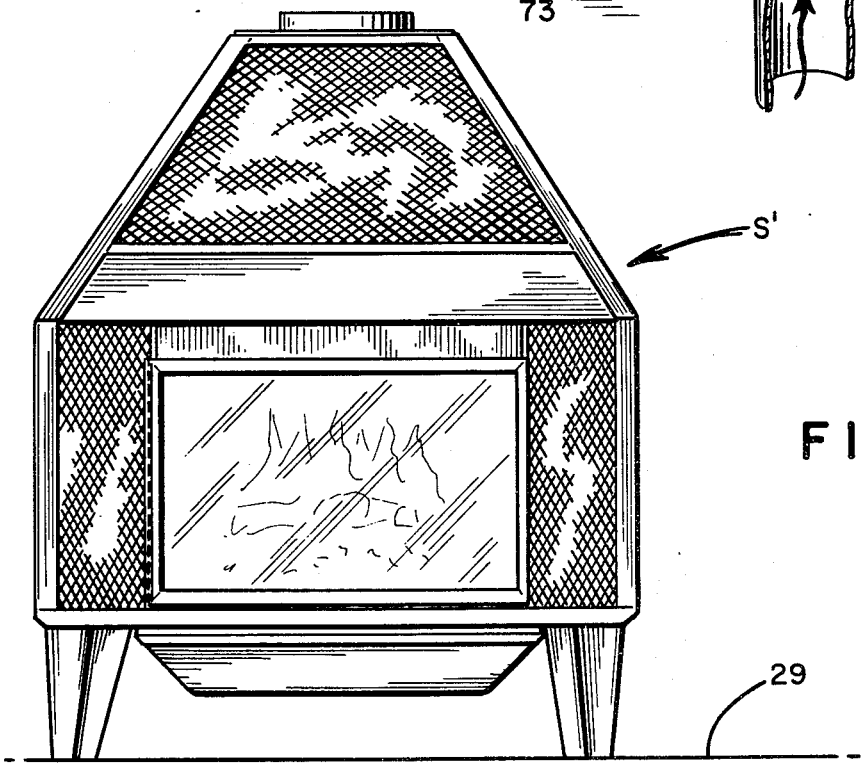
FIG. 5

FIREPLACE STOVE

This invention relates to heating apparatus and, more particularly, to a fireplace stove for use in an enclosed space in a zero clearance position.

BACKGROUND OF THE INVENTION

A common type of heating device for use in an enclosed space is a type which utilizes coal or wood and is formed in a compact construction for producing heat by means of which the surrounding air is heated. While such stoves generally perform satisfactorily, they have at least one significant disadvantage. During the operation of such stoves, the outer walls of the stove are generally at a temperature which is not only uncomfortable when touched, but fequently can cause burning, particularly due to accidental contact by young children or the like. Furthermore, the elevated temperatures at which the outer walls of such stoves are maintained prevent the use of such stoves closely adjacent to the walls of a building structure due to the potential fire hazard. One of the most sensitive areas for the installation of heating apparatus such as stoves is in the mobile home field in that they are readily combustible, and confined spaces in a mobile home present a particularly severe hazard. Therefore, the requirments for the use of such stoves in mobile homes are particularly rigid, and they require exceptional precautionary measures, such as the provision of ducting for air from the exterior of the mobile home to the stove for combustion in order to prevent the unhealthy and extremely dangerous consumption of the small quantity of air in such mobile homes. In addition, the typical stove on the market today, designed for mobile home installation, operates at such extreme temperatures at the outer surface so as to exceed acceptable or allowable limits prescribed for installation of such stoves against combustible surfaces in a mobile home.

BRIEF DESCRIPTION OF THE DRAWINGS

The invention will be further described, by way of example, with reference to the accompanying drawings in which:

FIG. 4 is a perspective view broken away of a portion of the stove of FIG. 1 illustrating the air flow path of the invention; and FIG. 5 is a front elevation view of a modification of the stove of the invention for use in standard dwellings.

DETAILED DESCRIPTION OF THE PREFERRED EMBODIMENTS

Figure 1:
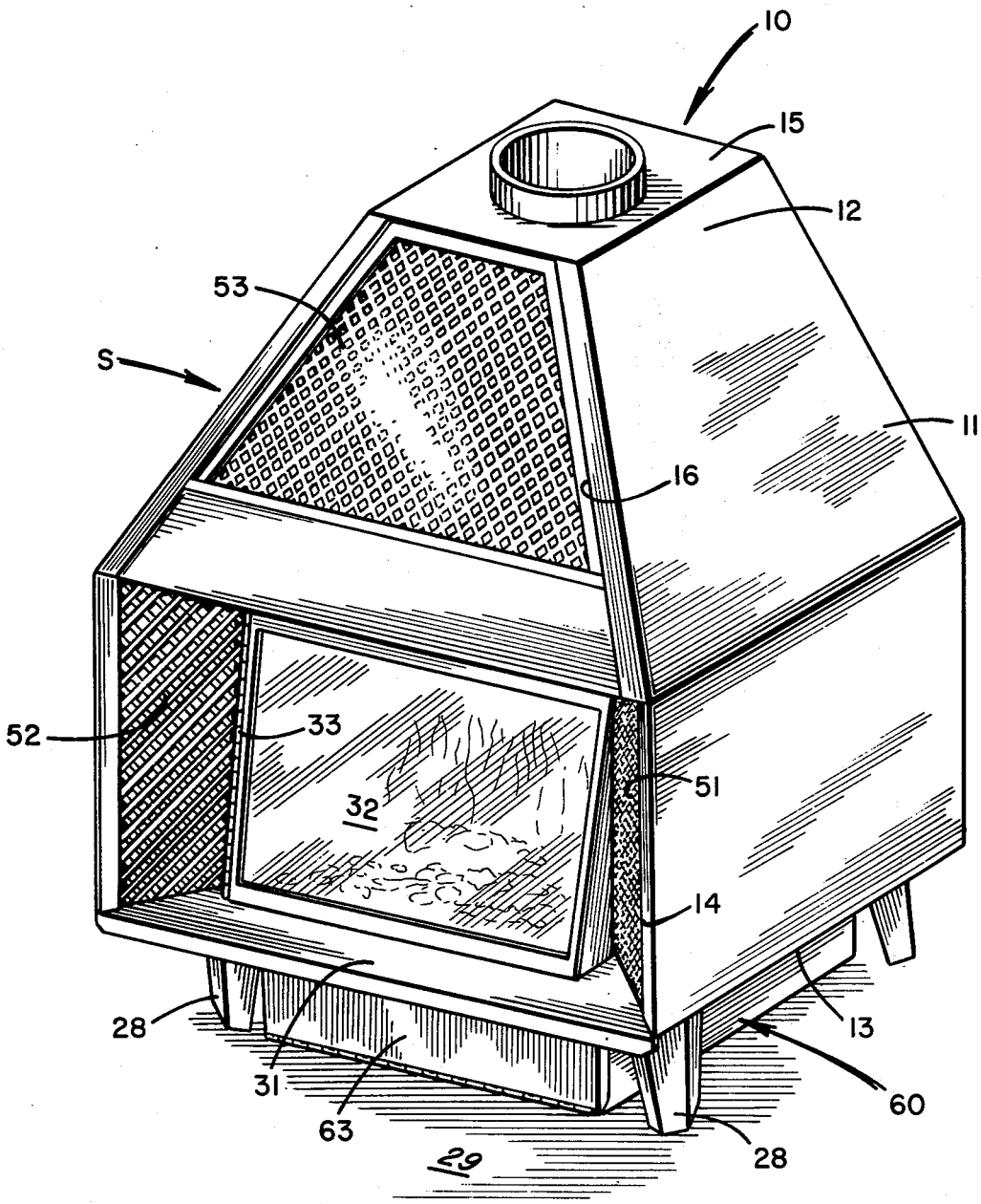
FIG. 1 is a prespective view of a preferred embodiment of a fireplace stove constructed in accordance with the invention.

Referring to the drawings and to FIG. 1 in particular, there is shown a preferred embodiment of the stove of the invention which is suitable for installation in a building structure such as a mobile home in a position which is defined as a "zero clearance" position, i.e., in contact with combustible surfaces, such as the wall structure of a mobile home.

Figure 3:
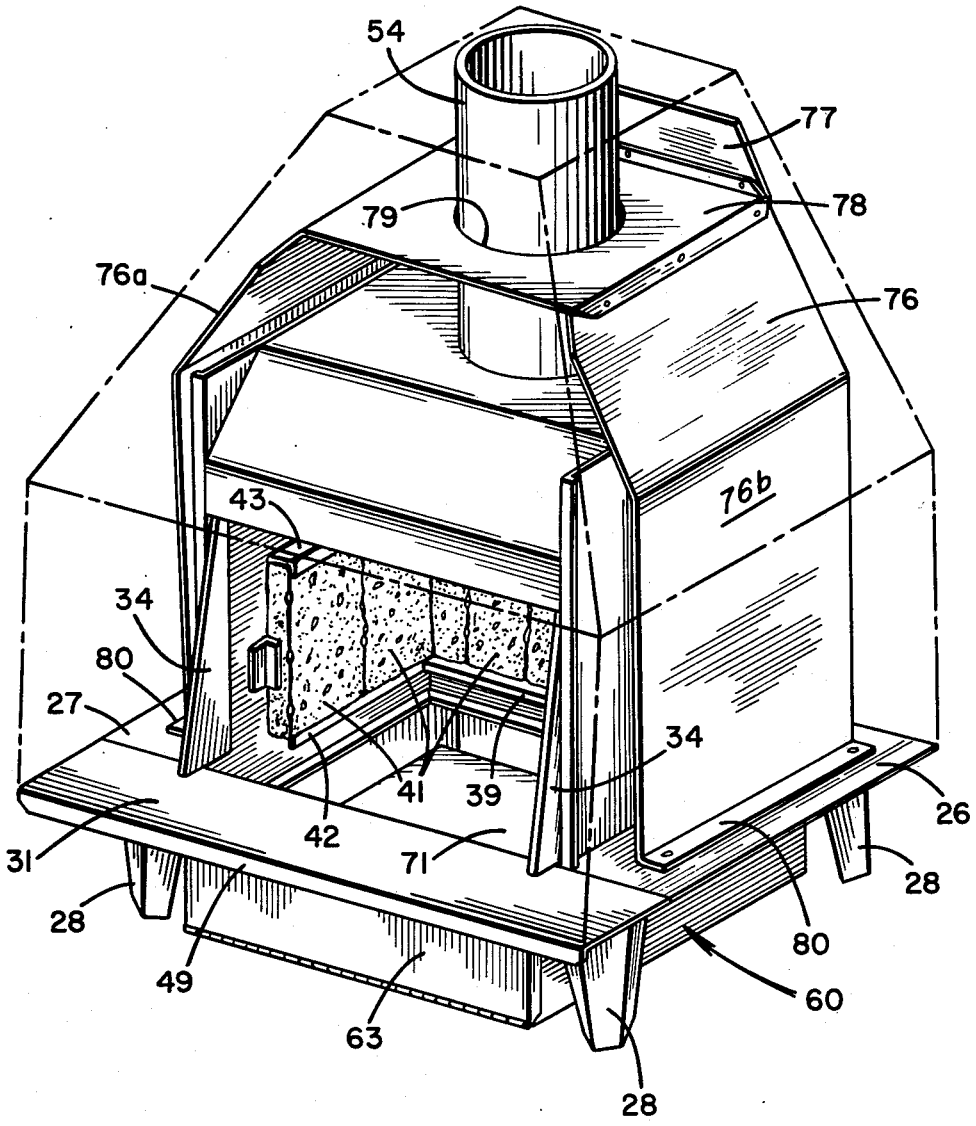
FIG. 3 is a perspective view of the stove of FIG. 1 with certain parts being removed for clarity.

The stove of the invention designated generally by the letter S in FIG. 1 includes an outer housing 10 having a sidewall 11, preferably tapered in a frustoconical shape at its upper portion 12 to provide a top wall 15. The housing sidewall 11 extends downwardly on three sides to a bottom edge 13 as shown best in FIG. 4 and is provided with a front opening 14, the configuration of the housing 11 in relation to the other parts of the stove being shown in broken lines in FIG. 3. Also provided is an opening 16 in the front of the stove S in the upper portion 12 of the housing sidewall 11, and the housing 11 defines an interior 17.

Figure 2:
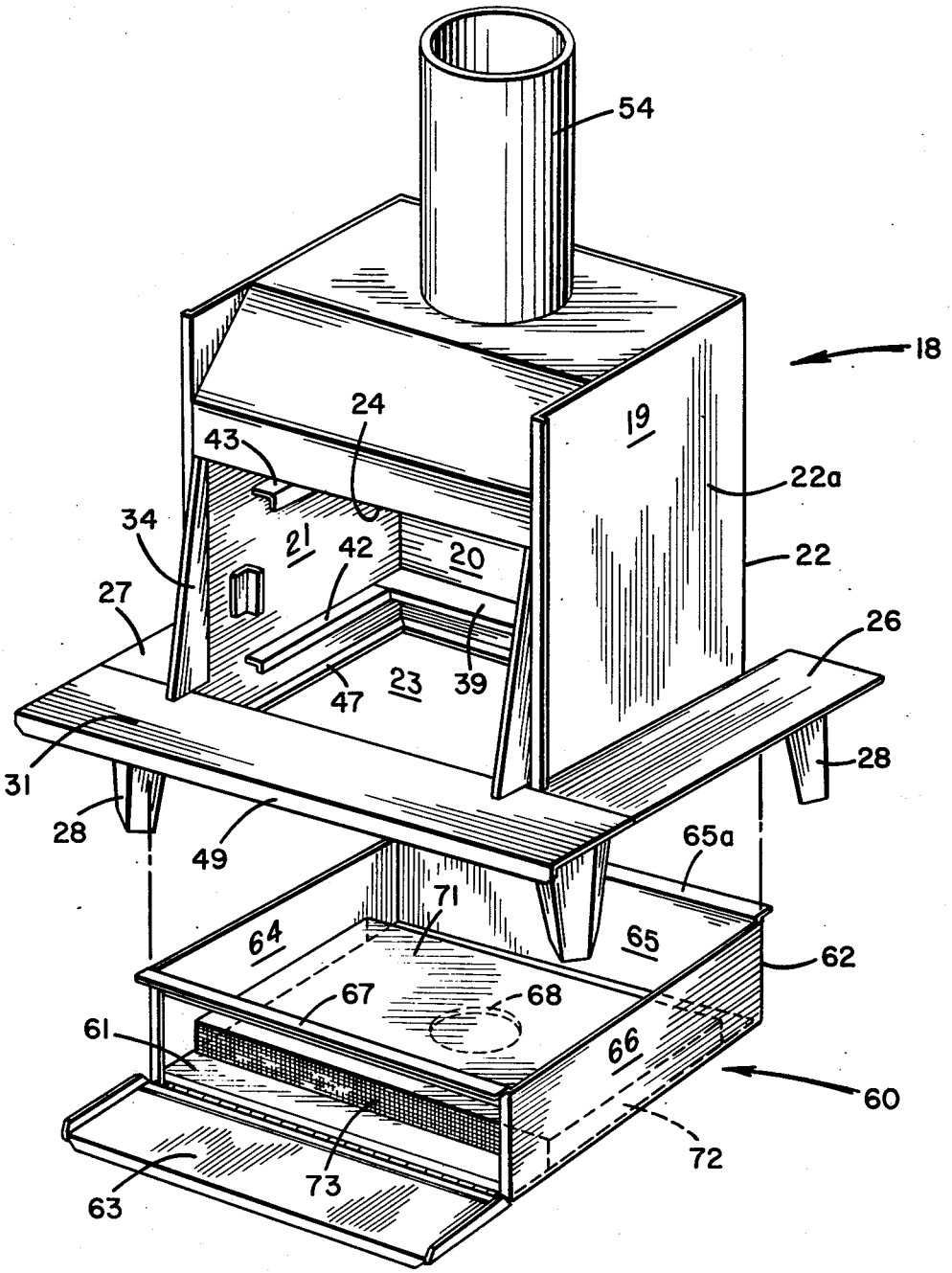
FIG. 2 is an exploded partial perspective view of the stove of FIG. 1.

The stove S is shown in FIG. 2 with the outer housing removed and also includes a combustion enclosure 18 which is disposed within the interior 17 of the housing 10 and is provided with three side panels 19, 20, 21 forming a sidwall 22 and defining an interior 23. Similarly to the housing sidewall 11, the combustion enclosure 18 is provided with an access opening 24 in the front of the stove S. The sidewall 22 of the combustion enclosure 18 is secured at its bottom edge portion to side plates 26, 27, the plates 26, 27 having a plurality of legs 28 suitably attached to and under the sides so that the combustion enclosure 18 and outer housing 10 are supported in an elevated spaced-apart relationship with a supporting surface, such as a floor 29 of the building structure in which the stove is installed.

Similarly, the bottom edge of the outer housing 10 is suitably secured to the side plates 26, 27 in surrounding relationship with the combustion enclosure 18 so that the outer surface 22*a* of the combustion enclosure sidewall 22 and the inner surface 11*a* of the housing sidewall 11 are disposed in spaced-apart relationship to define a clearance space for the passage of air to be heated.

At the front of the stove S, a plate 31 is suitably mounted to provide a hearth, and the access opening 24 of the combustion enclosure 18 is arranged to be closed by closure means such as a glass door 32 pivotally mounted by a suitable hinge 33 attached to member 34 mounted on the forward edge portion of the side panel 21 of the combustion enclosure 18. The access opening 24 is also arranged to be additionally closed by a screen 36 suitably mounted also on the member 34 behind the door 32 by means of a hinge 37.

Disposed within the interior 23 of the combustion enclosure 18 is fuel combustible means adjacent the bottom end portion of the enclosure 18. In the preferred embodiment, such fuel combustible means include a grate 38 supported at the front and rear by means of a hearth 31 and a bracket 39 suitably secured to the rear panel 20 of the combustion sidewall 22.

In order to provide a protective lining for the sidewall 22 of the combustion enclosure 18, a plurality of firebricks 41 are suitably positioned along the panels 19, 20, 21 of the enclosure sidewall 22, being supported at their bottom ends in an upstanding position by means of a rear bracket 39 and side brackets 42 suitably secured in a U-shaped configuration to the side panels 19, 20, 21 as shown best in FIG. 2. The upper portion of the firebricks 41 is detachably retained by means of brackets 43, also suitably mounted on sidewall panels 19–21 in a U-shaped configuration and in vertically spaced relationship with the lower brackets 39, 42. Thus, in the installation of the firebricks, the upper portions of the firebricks are received within the brackets 43, and the lower portions of the firebricks retained in position between lower brackets 39, 42 by retaining engagement between side and rear edges of the installed grate 38.

An ash receptacle 46 is removably positioned within the bottom opening of the combustion enclosure 18 below the grate 38 and is arranged for sliding movement below the hearth 31 by means of flanged side edges which underlie inwardly extending lips 47 on the bottom edge portions of the combustion enclosure 18. It will be noted that the front and rear edges of the receptacle 46 are provided with flanges 48 which, in the mounted position of the receptacle, are disposed in spaced relationship with the adjacent portion of the combustion sidewall 22 and a flange 49 of the hearth 31, an air passage being provided around the front flange 48 upwardly to the grate 38.

As can be seen in FIG. 2, the clearance space between the combustion enclosure sidewall 22 and outer housing sidewall 11 is closed along the bottom sides by supporting plates 26, 27, and air inlets 51, 52 are provided in the front of the stove S as shown best in FIG. 1, such inlets extending angularly between the sidewalls 22, 11 of the combustion enclosure 18 and housing 10, respectively. The air inlets 51, 52, which admit air from the space surrounding the stove S, permit air to flow within the clearance space for heating and for ultimate discharge through an outlet opening 53 formed in the upper portion 12 of the housing 10. Preferably, the inlets 51, 52 and outlet 53 are provided with a suitable screen material, such as perforated metal. Also, conduit means, such as a duct 54, is provided in the stove S which extends between the upper portion of the combustion enclosure 18 through the clearance space and the top wall 15 of the housing 10 so as to remove combustion gases from the interior 23 of the combustion 18.

Disposed in the clearance space between sidewall 22 of the combustion enclosure 18 and the housing sidewall 11 is an intermediate partition 76 formed of sheet metal or the like, the partition 76 having inner and outer surfaces 76*a*, 76*b*, which are disposed in spaced-apart relationship with the sidewall surfaces 22*a* and 11*a*, respectively. As shown best in FIG. 3, the partition 76 is of substantially U-shaped configuration, with a rear wall 77 and a top wall 78 in which an opening 79 is provided for accommodating the duct 54. The partition 76 is suitably secured to the side plates 26, 27 by the provision of side flanges 80 mounted by means of rivets or the like to the upper surfaces of the side plates 26, 27.

Although the stove of the invention with the above-described construction, and as shown in FIG. 5, where it is identified by the letter S' is suitable for heating air in a building structure, such as a home, the special requirements for installation of the stove of the invention in a mobile home require a construction in accordance with the embodiment of FIGS. 1–4, wherein combustion air utilized for combustion must be brought in from the exterior of the mobile home.

Accordingly, there is provided, as shown best in FIGS. 2, 4, a supplementary enclosure 60, which is arranged to be positioned within the space between the supporting surface 29 and the lower ends of the housing 10 and combustion enclosure 18. More specifically, the supplementary enclosure 60 includes a bottom wall 61, a sidewall 62 having a pivotally mounted front panel 63 and side panels 64, 65, 66, the upper edge of side panel 65 preferably being provided with a flange 65*a*, and the front portion of the enclosure 60 being provided with an upper L-shaped flange 67 against which the upper edge of front panel 63 fits.

The bottom panel 61 of enclosure 60 is preferably removably mounted within the enclosure 60 and includes at least one opening 68 which is arranged to be communicated with the air on the other side of the supporting surface 29, such as the outside of a mobile home, through suitable means such as a flanged duct 69. It should be understood that the opening 68 in panel 61 may be located in any suitable position on the panel so as to permit the panel to be either rotated and/or inverted to align with the suitably provided opening in the surface 29, and more than one such opening 68 may be provided. Additionally, the opening 68 may be located in one of the side panels 64–66.

Also located in the enclosure 60 is a panel 71 disposed in spaced-apart relationship with the bottom wall 61 provided with side flanges 72 by means of which the panel is supported in an elevated position with respect to the bottom wall 61. The spaces between the front and rear edges of the panel 71 and the bottom wall 61 form gaps which are preferably provided with a suitable screen or the like preventing the passage therethrough of insects to the interior of the stove or combustion products to the exterior of the home.

The enclosure 60 is positioned as shown best in FIG. 4 in surrounding relationship with the lower portions of the sidewalls 19–21 of the combustion enclosure 18, with the L-shaped member 67 disposed between the hearth flange 49 and the flange 48 on the ash receptacle 46. The flange 65*a* on the enclosure back panel 65 is disposed in closely adjacent relationship with the rear portion of the housing sidewall 11 as shown best in FIG. 4, and the upper portions of the enclosure side panels 64–66 are disposed adjacent the outer surfaces of side panels 19–21 of the combustion enclosure 18 below the side plates 26, 27.

In the operation of the embodiment of FIG. 1, the free-standing stove S is positioned in a selected position within a building structure, such as a mobile home, by first attaching the enclosure 60 to the supporting surface 29 in the selected location wherein the opening 68 communicates with the adjacent opening in the supporting surface 29 through which the duct 69 is to extend. The enclosure 60 may be secured to the surface 29 by suitable means, such as screws, extending through the panel 61, which engage the underlying surface 29. The duct 69 is then inserted through the opening 68 and the corresponding opening in the surface 29, with the flange on the upper end of the duct 69 engaging the bottom wall 61. The panel 71, together with the screen 73, is then installed within the enclosure 60 as shown in FIG. 2.

The stove S is then positioned over the enclosure 60 as described above, with the legs 28 extending adjacent the side panels 64, 66 of the supplementary enclosure 60. At the same time, a suitable connection is made to the duct 54 at the top of the stove S through a duct of suitable length to vent the combustion gases from the stove to the exterior of the mobile home.

With the parts of the stove positioned as shown in FIG. 4, a suitable fuel, such as coal or wood, is then introduced through the access opening 24 of the combustion enclosure 18, the screen 36 and door 32 being pivoted into an open position. The fuel is then ignited, and combustion proceeds so that the draft created within the stove draws in air from outside the mobile home through the duct 69 as shown by the solid arrows in FIG. 4. This combustion air then travels under plate 71, through the screen 73, over the upper surface of the panel 71, under and over the bottom surface of the ash receptacle 46, to subsequently move over the flange 48 of the ash receptacle 46 into contact with the burning fuel, the resulting combustion gases being subsequently moved upwardly in the direction of the solid arrows through the duct 54 to the exterior of the mobile home. As a result of this air flow pattern, the incoming air has a cooling effect on the plate 71 and the associated parts of the enclosure 60, thereby maintaining the temperature of these parts at an extremely low level absolutely preventing any burning of any combustible materials in the area, such as a rug or the like.

A small portion of the incoming air passes through the space between the combustion enclosure sidewall 11 and the partition 76 as indicated by the solid arrows, and moves upwardly in this space for discharge in a heated condition into the space surrounding the stove S through the outlet 53.

Accompanying this air movement is the introduction of the air within the space to be heated between the partition 76 and the housing sidewall 11 through the inlets 51, 52 and at the rear of the stove S by the combustion enclosure sidewall 22 and the the housing sidewall 11 as indicated by the open arrows in FIG. 4. The air flowing in the space as indicated by the open arrows is heated as it moves upwardly and flows through the outlet 53 in a heated condition joining the heated air described above as indicated by the solid arrows.

The air flowing upwardly in the passage between the sidewall 22, partition 76, and sidewall 11 absorbs the heat from the surfaces of the two sidewalls 11, 22 and partition 76, the partition 76 absorbing radiant heat from the sidewall 22 and passing this heat by convection to the air flowing on both sides of the partition 76, as well as simultaneously cooling all of the surface of the housing sidewall 11 so that the outer surface of the housing sidewall is virtually cool to the touch.

In the embodiment of FIG. 5, wherein the enclosure 60 is not utilized, essentially the same function is obtained as described with respect to the embodiment of FIGS. 1–4. However, rather than the air being brought from the outside of the dwelling for combustion and heating, all of the air for combustion and heating is obtained from the space within the dwelling. Nevertheless, the outer surface of the stove S′ is maintained at substantially the same reduced temperature as that of the stove S.

What is claimed is:

1. A freestanding fireplace stove for heating a space within a building structure comprising, in combination, a housing having a sidewall including a bottom edge and an upper portion defining an interior, a combustion enclosure having a sidewall defining an interior and a bottom end portion disposed within the interior of said housing, with the outer surface of said combustion enclosure sidewall in spaced-apart relationship with the inner surface of said housing sidewall to define a clearance space for providing a passage for air to be heated, partition means disposed within said clearance space arranged substantially parallel to said housing sidewall and said combustion enclosure sidewall in spaced relationship with both said enclosure sidewall and said housing sidewall for the transfer of radiant heat from said combustion enclosure sidewall to the air flowing within said clearance space, means for supporting said housing and said combustion enclosure on a supporting surface within the building structure, fuel combustion means disposed within said combustion enclosure adjacent said combustion enclosure bottom end portion, an access opening in said combustion enclosure, closure means for closing said access opening, air inlet means for admitting air to be heated into said clearance space, air outlet means for discharging heated air from said clearance space into the space to be heated in the building structure, conduit means connected to said combustion enclosure and extending through said housing side wall upper portion for removing combustion gases from the interior of said combustion enclosure.

2. A freestanding fireplace stove in accordance with claim 1 wherein said fuel combustion means includes a grate for supporting a combustion medium, means for supporting said grate in said combustion enclosure adjacent said bottom end portion, an ash receptacle in said combustion enclosure bottom end portion below said grate means to permit the introduction of combustion air from the exterior of said housing into the interior of said combustion enclosure, and refractory material arranged along the inside of the sidewall of said combustion enclosure.

3. A fireplace stove in accordance with claim 2 including a supplementary enclosure having a sidewall, a bottom wall having at least one opening and an open upper end, means for mounting said enclosure within said housing bottom end in surrounding relation with the bottom end portion of said combustion enclosure, with said supplementary enclosure bottom wall in overlying engagement with said supporting surface, means for conducting air through said supporting surface and said supplementary enclosure, deflector means within the interior of said supplementary enclosure to direct the outside air over the upper surface of said deflector means and into both said combustion enclosure and said clearance space.

4. A fireplace stove in accordance with claim 3 wherein said deflector means includes a deflector panel, means for mounting said panel in the interior of said supplementary enclosure in vertically spaced relationship with said bottom wall, said deflector panel having a front marginal edge and a rear marginal edge defining with said bottom wall a pair of gaps for the passage of combustion air flowing through said bottom wall opening over the upper surface of said deflector panel in heat transfer relationship therewith.

5. A fireplace stove in accordance with claim 4 including a screen in each of said gaps for preventing the entry of insects from the space in the building structure and the exiting of combustion products to the exterior of said building structure.

6. A fireplace stove in accordance with claim 4 wherein the lower rear panels of said combustion enclosure sidewall, said intermediate partition, and said housing sidewall are disposed in spaced-apart relationship to provide an inlet to said clearance space for air from the space to be heated.

* * * * *